US008464636B2

(12) United States Patent
Seidler et al.

(10) Patent No.: US 8,464,636 B2
(45) Date of Patent: Jun. 18, 2013

(54) DEVICE FOR CONTROLLING A SHEET-FED ROTARY PRINTING MACHINE HAVING A PLURALITY OF DRIVE MOTORS

(75) Inventors: Malte Seidler, Heidelberg (DE); Detlef Strunk, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1025 days.

(21) Appl. No.: 12/253,542

(22) Filed: Oct. 17, 2008

(65) Prior Publication Data

US 2009/0101031 A1 Apr. 23, 2009

(30) Foreign Application Priority Data

Oct. 17, 2007 (DE) ..... 10 2007 049 642

(51) Int. Cl.
*B41F 5/02* (2006.01)

(52) U.S. Cl.
USPC ..... 101/183; 101/216; 101/483; 318/45

(58) Field of Classification Search
USPC ..... 101/480
See application file for complete search history.

(56) References Cited

U.S. PATENT DOCUMENTS 3,688,167 A * 8/1972 Ivey et al. ..... 318/45
5,377,589 A * 1/1995 Kruger et al. ..... 101/216
5,404,418 A * 4/1995 Nagano ..... 388/806
5,615,609 A * 4/1997 Hill et al. ..... 101/183
5,708,332 A 1/1998 Böttger et al.
5,874,813 A * 2/1999 Bode et al. ..... 318/98
6,823,792 B2 * 11/2004 Grutzmacher et al. ..... 101/483
7,187,142 B2 * 3/2007 Rehm ..... 101/183

FOREIGN PATENT DOCUMENTS

DE 41 32 765 A1 4/1993
DE 42 28 506 A1 3/1994
DE 195 02 909 B4 8/1996
DE 197 04 702 A1 8/1998

OTHER PUBLICATIONS

German Patent and Trademark Office Search Report, dated Jul. 1, 2008.

* cited by examiner

*Primary Examiner* — Jill Culler

(74) *Attorney, Agent, or Firm* — Laurence A. Greenberg; Werner H. Stemer; Ralph E. Locher

(57) ABSTRACT

A sheet-fed rotary printing machine includes at least two electric drive motors acting on a gearwheel train which mechanically connects a plurality of printing units to one another. A device for controlling the printing machine includes a control loop for each electric drive motor having a higher-frequency control element. At least one control loop has a low-frequency control element supplying an output signal picked up at the control loops in a predetermined ratio. A sheet-fed rotary printing machine having the device is also provided.

14 Claims, 3 Drawing Sheets

DEVICE FOR CONTROLLING A SHEET-FED ROTARY PRINTING MACHINE HAVING A PLURALITY OF DRIVE MOTORS

CROSS-REFERENCE TO RELATED APPLICATIONS

This application claims the priority, under 35 U.S.C. §119, of German Patent Application DE 10 2007 049 642.9, filed Oct. 17, 2007; the prior application is herewith incorporated by reference in its entirely.

BACKGROUND OF THE INVENTION

Field of the Invention

The present invention relates to a device for controlling a sheet-fed rotary printing machine having at least two electric drive motors acting on a gearwheel train. The gearwheel train mechanically connects a plurality of printing units in the sheet-fed rotary printing machine to one another. The invention also relates to a sheet-fed rotary printing machine having the device.

Sheet-fed rotary printing machines are formed of a plurality of printing units, with each printing unit being intended for applying a color separation to sheet-like printing material. That means that a printing unit has to be present for every color separation. Since, in addition to the basic colors, some special colors or lacquers are usually also used, a large number of printing units may come together, particularly when the sheet-fed rotary printing machine has a turning device for recto and verso printing. In that case, double the number of printing units must be present for printing on the front side and the rear side of a sheet. That leads to very long sheet-fed rotary printing machines having, at the present time, up to 16 printing units. Since all of the color separations on the printing material have to be printed one above the other exactly in-register and corner-accurately in order to achieve a sufficiently high printing quality, the individual printing units have to be coupled to one another correspondingly exactly. In sheet-fed rotary printing machines, that coupling usually takes place through the use of a gearwheel train which connects all of the printing units to one another mechanically. That mechanical connection allows in-register printing and consequently the exact printing of the individual color separations one above the other in the printing units, since the aim is to avoid tooth surface play or clearance between the individual wheels of the gearwheel train. However, as a result of that braced mechanical coupling of the individual printing units, vibrations are excited which are all the more violent and all the more difficult to control, the more printing units are present. Those vibrations, in turn, have an effect on the printing image, and therefore long sheet-fed rotary printing machines having a large number of printing units cannot be controlled so simply in terms of vibration.

A further problem in long sheet-fed printing machines is the transmission of the required drive power. In the case of a large number of printing units, a correspondingly large main drive motor would have to be employed, which drives all of the printing units through the gearwheel train during printing operation. Instead of one main drive motor, however, a plurality of drive motors of smaller dimensions may also be used, which likewise all act jointly on the gearwheel train. Such a multi-motor drive for a sheet-fed printing machine, the printing units of which are connected to one another through the use of a gearwheel train, is known from German Patent DE 195 02 909 B4, corresponding to U.S. Pat. No. 5,708,332. The printing units connected through a gearwheel train have a variable-speed master motor and a second motor, with a variable torque as a function of the torque of the master motor, in one of the other printing units. The master motor and the variable-torque motor are controlled through controlled systems of the motor torques. That activation takes place through a speed governor of the master motor, at the output of which there is an overall torque which is approximately proportional to a sum of the motor currents and which is distributed to the two motors in an adjustable ratio. In addition, a motor current limiter which is disposed between the current regulator and the variable-torque motor filters current peaks out of the motor current. The filtering of the current peaks is intended to reduce the risk of vibrations. Thus, in long machines, a situation is prevented where the multi-motor drive generates additional vibrations, while at the same time the wheel train is to be relieved.

A speed governor device for a multi-motor drive for sheet-fed rotary printing machines is also known from German Published, Non-Prosecuted Patent Application DE 41 32 765 A1. The printing units connected to one another through a gearwheel train have a master drive motor and at least one further drive motor. The master drive motor has a variable speed, with its speed being detected by a tachogenerator. Each further drive motor of the sheet-fed rotary printing machine has a motor current regulator which, in contrast to the master drive motor, does not have a variable speed, but has a variable torque. Through the use of that type of governor device, exact tooth face bearing contact is to be achieved, in order to improve the printing quality. Furthermore, through the use of the actuating device, it is possible to coordinate the torques between further drive motors with one another.

SUMMARY OF THE INVENTION

It is accordingly an object of the invention to provide a device for controlling a sheet-fed rotary printing machine, in particular having a large number of printing units with a plurality of drive motors, as well as a sheet-fed rotary printing machine having the device, which overcome the hereinaforementioned disadvantages of the heretofore-known devices of this general type and which allow particularly effective vibration damping during printing operation.

With the foregoing and other objects in view there is provided, in accordance with the invention, in a sheet-fed rotary printing machine having a plurality of printing units, a gearwheel train mechanically interconnecting the printing units and at least two electric drive motors acting on the gearwheel train, a device for controlling the sheet-fed rotary printing machine. The device comprises control loops each associated with a respective one of the electric drive motors. Each of the control loops has a respective higher-frequency control element and at least one of the control loops has a low-frequency control element supplying an output signal picked up at the control loops and applied to the control loops in a predetermined ratio.

According to the present invention the printing units of a sheet-fed rotary printing machine are coupled to one another mechanically through a gearwheel train, with at least two electric drive motors acting on the gearwheel train. For particularly effective vibration damping, the electric drive motors are each assigned a respective control loop with a control element, the transmission properties of which act mainly on a higher frequency range and only slightly on the direct component and low frequencies and which is referred to below as a higher-frequency control element. Moreover, in the case of at least one of the drive motors, a control loop is present, having a control element, the transmission properties of which act mainly on a low frequency range and the direct component and which is referred to below as a low-frequency control element. Its output signal is picked up in a predetermined ratio at the control loops for the torques of the drive motors. Whereas, in the prior art according to German Patent DE 195 02 909 B4, corresponding to U.S. Pat. No. 5,708,332, the higher-frequency components of the actuating torque are filtered out through the use of a low-pass filter, in order to thereby avoid at least the stimulation of vibrations, according to the present invention this component is not filtered out, but is used for active vibration damping. Consequently, not only is the excitation of additional vibrations avoided as in German Patent DE 195 02 909 B4, corresponding to U.S. Pat. No. 5,708,332, but the higher-frequency component is also utilized in order to actively damp vibrations which occur. For this purpose, each electric drive motor has a specific control loop with a higher-frequency control element, through the use of which this active vibration damping can be brought about. Thus, the control loops of both motors have a vibration reducing action. In addition, through the low-frequency control element, the torques for production run printing are allocated to the individual drive motors in a predetermined ratio. Since virtually no higher-frequency components are present in this low-frequency output signal, the low-frequency signal cannot stimulate vibrations. Particularly effective vibration damping is consequently achieved, without complicated regulating components, such as filters, observers, etc., having to be used.

In accordance with another feature of the invention, the device has a proportional controller as a higher-frequency control element and an integral controller as a low-frequency control element. Proportional and integral controllers are standard components in control technology. According to the invention, each control loop of the drive motor is assigned a proportional controller for regulating the higher-frequency components, while exactly one integral controller is provided for regulating the low-frequency components. For this purpose, in the control loop having two control elements, a combined proportional/integral controller is provided which is separated into a proportional and an integral component. The low-frequency output signal of the integral controller is supplied to the torque controllers of the drive motors as desired values in a predetermined ratio which may also have a negative sign, in order to thereby carry out the desired torque distribution of the drive motors.

In accordance with a further feature of the invention, advantageously, each drive motor is assigned a sensor for detecting the actual speed or the actual torque. This sensor may be integrated into the drive motor or be located in the vicinity of the drive. The more closely the location of measurement by the sensor and the location of actuating action by the drive motor lie to one another, the more simply the vibration-reducing action can be implemented. The individual control loops can minimize the vibrations which occur through the use of the detected actual speed or actual torque values of the sensors.

In accordance with an added feature of the invention, the amplification factors of the proportional controllers are different. Thus, individual control loops can be coordinated with special vibrational features of the sheet-fed rotary printing machines. The vibrations occurring in a sheet-fed rotary printing machine occur in a local distribution over the entire length of the printing machine which takes place as a function of the vibration frequencies of exciting characteristic forms. If a drive motor lies in a vibration node of the first characteristic form and therefore cannot exert either a damping or a stimulating action on this form of vibration then, in this case, the amplification factor can be set as zero or can at least be set sharply down. Thus, the characteristic forms of the vibrations at the characteristic frequencies can be taken into account through the different amplification factors of the proportional controllers.

In accordance with an additional feature of the invention, the higher-frequency components are multiplied by a negative amplification factor and are picked up at the torque controller of a drive motor. In this concept, the stimulating part of the actuating torque is not removed through the use of a low-pass filter, as in German Patent DE 195 02 909 B4, corresponding to U.S. Pat. No. 5,708,332 but instead, the higher-frequency components are multiplied by a negative amplification factor and supplied to the torque controller of at least one drive motor. Due to the sign inversion, the higher-frequency vibration fractions are not simply filtered away, but are inverted to the negative and thus used for active vibration reduction. For improved regulation, the higher-frequency component may in this case be supplied first to a bandpass filter. The sign of the adjustment factor preferably depends on the characteristic form of the vibration of the sheet-fed rotary printing machine at the location of the drive motor. Supplying the higher-frequency component in a bandpass filter ensures that only higher frequencies are used for regulation. The higher-frequency component is thus utilized for the active damping of the vibrations for the respective drive motor by virtue of the sign inversion.

In accordance with yet another feature of the invention, the sheet-fed rotary printing machine has a plurality of printing units which can be coupled to one another mechanically through at least one turning device. In sheet-fed rotary printing machines with turning devices, the machine must be capable of being divided at the turning device for the changeover from recto to verso printing. This means that a mechanical coupling must be provided, which is correspondingly loaded during printing operation, if only one drive motor is present. Therefore, in the case of long machines, in order to relieve the coupling, a plurality of motors must be provided at the turning device, with at least one drive motor being disposed upstream of the turning configuration and one drive motor downstream of the turning configuration. These drive motors are activated for control by the device according to the invention in such a way that vibrations which occur are damped actively. Consequently, on one hand, the printing quality is improved and, on the other hand, the mechanical coupling is relieved.

With the objects of the invention in view, there is concomitantly provided a sheet-fed rotary printing machine having the device according to the invention.

Other features which are considered as characteristic for the invention are set forth in the appended claims.

Although the invention is illustrated and described herein as embodied in a device for controlling a sheet-fed rotary printing machine having a plurality of drive motors and a sheet-fed rotary printing machine having the device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
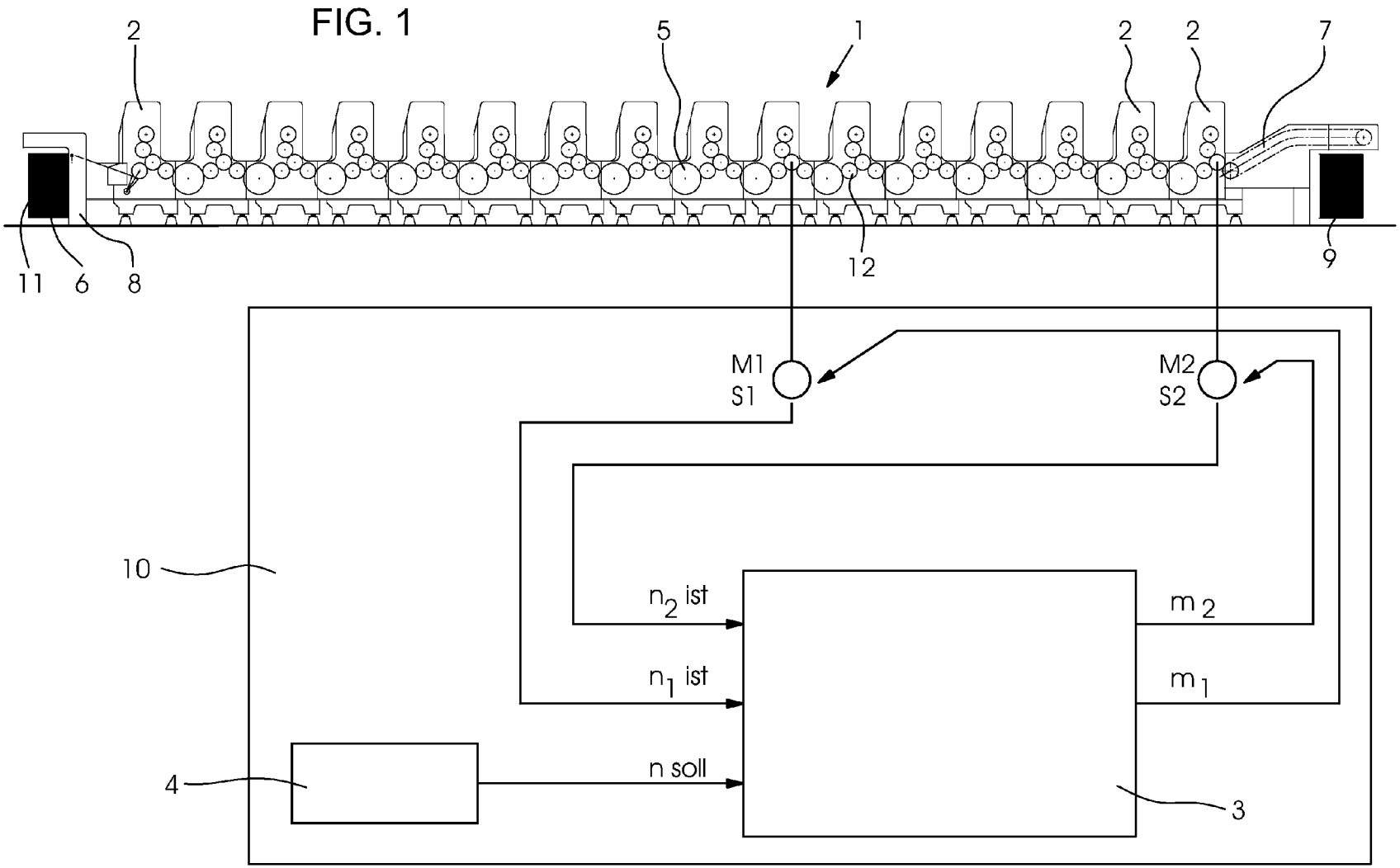
FIG. 1 is a longitudinal-sectional view of a long sheet-fed rotary printing machine having two drive motors and a control computer in a block circuit diagram.

Referring now to the figures of the drawings in detail and first, particularly, to FIG. 1 thereof, there is seen a sheet-fed rotary printing machine 1 which has sixteen printing units 2. The printing units 2 are set up identically and are coupled to one another mechanically through a gearwheel train. This ensures that individual color separations are printed one above the other onto sheet-like printing material or carriers 11 in the printing machine 1 in-register and corner-accurately. The sheet-like printing material 11 is extracted in a feeder 8 from a feeder stack 6 and supplied to the first printing unit 2. From there, the sheets 11 are transported through the entire sheet-fed printing machine 1 through the use of cylinders 5 and are deposited at the end on a delivery stack 9 at a delivery 7. Due to the large number of printing units 2, the sheet-fed rotary printing machine 1 in FIG. 1 is not driven by a single drive motor, but has two drive motors M1, M2. The first drive motor M1 acts on the tenth printing unit, while the second drive motor M2 acts on the last or sixteenth printing unit 2. Moreover, between the tenth and eleventh printing units 2, the sheet-fed rotary printing machine 1 has a turning drum 12 which makes it possible to print sheets 11 in recto and verso printing on the front side and on the rear side. Since the drive motors M1 and M2 are disposed upstream and downstream of the turning drum 12, a coupling in the turning drum 12 is relieved during printing operation. Moreover, each drive motor M1, M2 is assigned a respective speed sensor or rotary encoder S1, S2. Thus, for each drive motor M1, M2, actual speeds $n1_{act}$ and $n2_{act}$ are detected independently of one another. Output signals from the rotary encoders S1, S2 are supplied to a control computer 10 of the printing machine 1. The control computer can activate all of the drive motors M1, M2, as well as non-illustrated secondary drives and actuating drives in the printing units 2 of the printing machine 1. The control computer 10 has a controller 3 for which a desired machine speed $n_{des}$ is predetermined through a control desk 4. This desired speed $n_{des}$ is predetermined by the operator of the printing machine 1 in order to thereby select the desired printing speed. In addition to the desired speed $n_{des}$, the actual speed values $n2_{act}$ and $n1_{act}$ of the drive motors M1, M2 are supplied to the controller 3. As a result of control, actuating torques m1, m2 are picked up at the motors M1, M2 as output signals from the controller 3, in order to thereby correct deviations which have occurred, in the case of speed deviations between the desired speed $n_{des}$ and actual speed $n1_{act}$, $n2_{act}$. In addition to the function of speed control, the controller 3 also serves for vibration damping. This property is described in more detail with reference to FIGS. 2 and 3.

Figure 2:
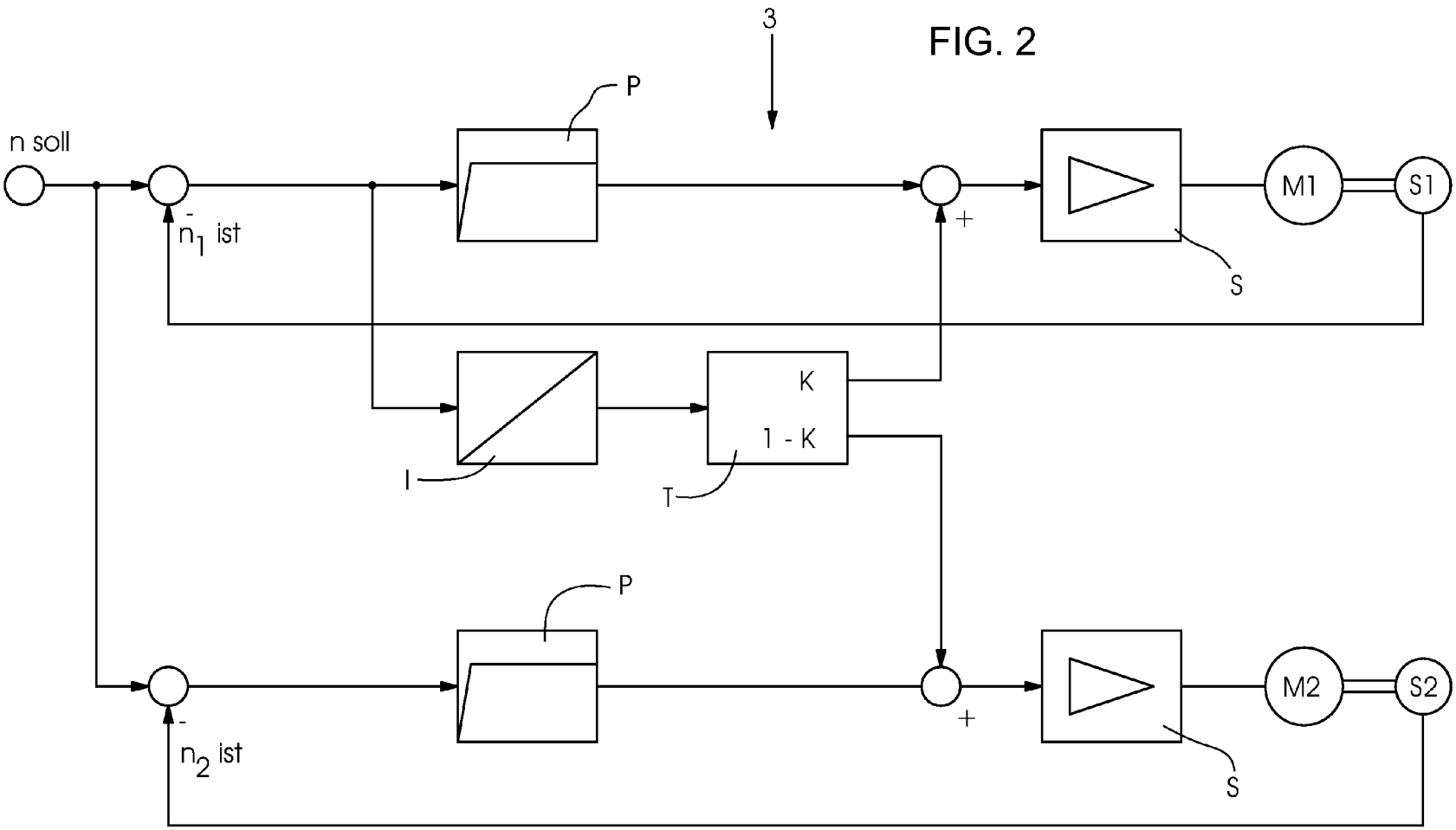
FIG. 2 is a block circuit diagram of a device according to the invention with proportional control loops for each drive motor and with a common integral controller.

According to FIG. 2, the controller 3 is formed of two coupled control loops. One control loop is assigned to the first drive motor M1 and another control loop is assigned to the second drive motor M2. The desired speed $n_{des}$ is supplied as a desired value to the controller 3. Furthermore, the actual speeds $n2_{act}$ and $n1_{act}$ are detected through the rotary encoders S1, S2, which are each assigned to a respective one of the motors M1, M2, and are likewise supplied to the controller 3. In this case, a first control loop is supplied with the speed $n1_{act}$ of the first motor, while a second control loop is supplied with the speed $n2_{act}$ of the second motor. The first control loop has a proportional controller P which mainly regulates higher-frequency components. Moreover, a control difference of the first control loop is supplied to an integral controller I which allocates its output signal in a division element T to the control loops of the first motor M1 and of the second motor M2 in a predetermined ratio. In the present exemplary embodiment, a low-frequency output signal corresponds to an average sum torque of the sheet-fed printing machine 1 which is required in order to overcome friction. This signal is, in this exemplary embodiment, allocated to the motors M1 and M2 in a fixed ratio of 60 to 100 with K=0.625. However, allocation with a negative sign is also possible. One example would be an allocation of 120 to −20 with K=1.2. K depends on the structural conditions of the printing machine 1. The second control loop of the second motor M2 does not have an integral controller I. In this case, instead, the corresponding component of the division element T is picked up from the first control loop. The two control loops are each followed by a respective controller for the torque with a power part S, which converts the signals into the corresponding currents for the drive motors M1, M2. The low-frequency signal serves for setting the torque distribution of the printing machine 1 and, because of its low frequency, has no vibration-stimulating action. Since each control loop in FIG. 2 has a specific proportional controller P, the higher-frequency vibration component can thus be damped through the use of each of the drive motors M1, M2.

Amplification factors of the individual proportional controllers P may be selected differently according to the configuration of the drive motors M1, M2 in the sheet-fed printing machine 1. In special instances, it may be advantageous in this case to set the amplification factor for specific drives at zero or at least sharply down. This is dependent on the location of the drive as a function of the characteristic form of the vibrations which occur. The control concept can easily also be extended to more than two drive motors M1, M2. Instead of the proportional controller P and the integral controller I used in this case, complicated drive controllers may also be used. However, the use of a separated Pi controller with a proportional component P and an integral component I constitutes a particularly simple and cost-effective configuration. Consequently, lower-frequency and higher-frequency components can be separated in the control in a particularly simple way, with the lower-frequency components being allocated to the drive motors M1, M2 in a fixed ratio through the use of the division element T. By contrast, for the higher-frequency components in the controller 3, each of the drive motors M1, M2 acquires a specific independent control loop, each with a proportional controller P, for optimal vibration damping.

Figure 3:
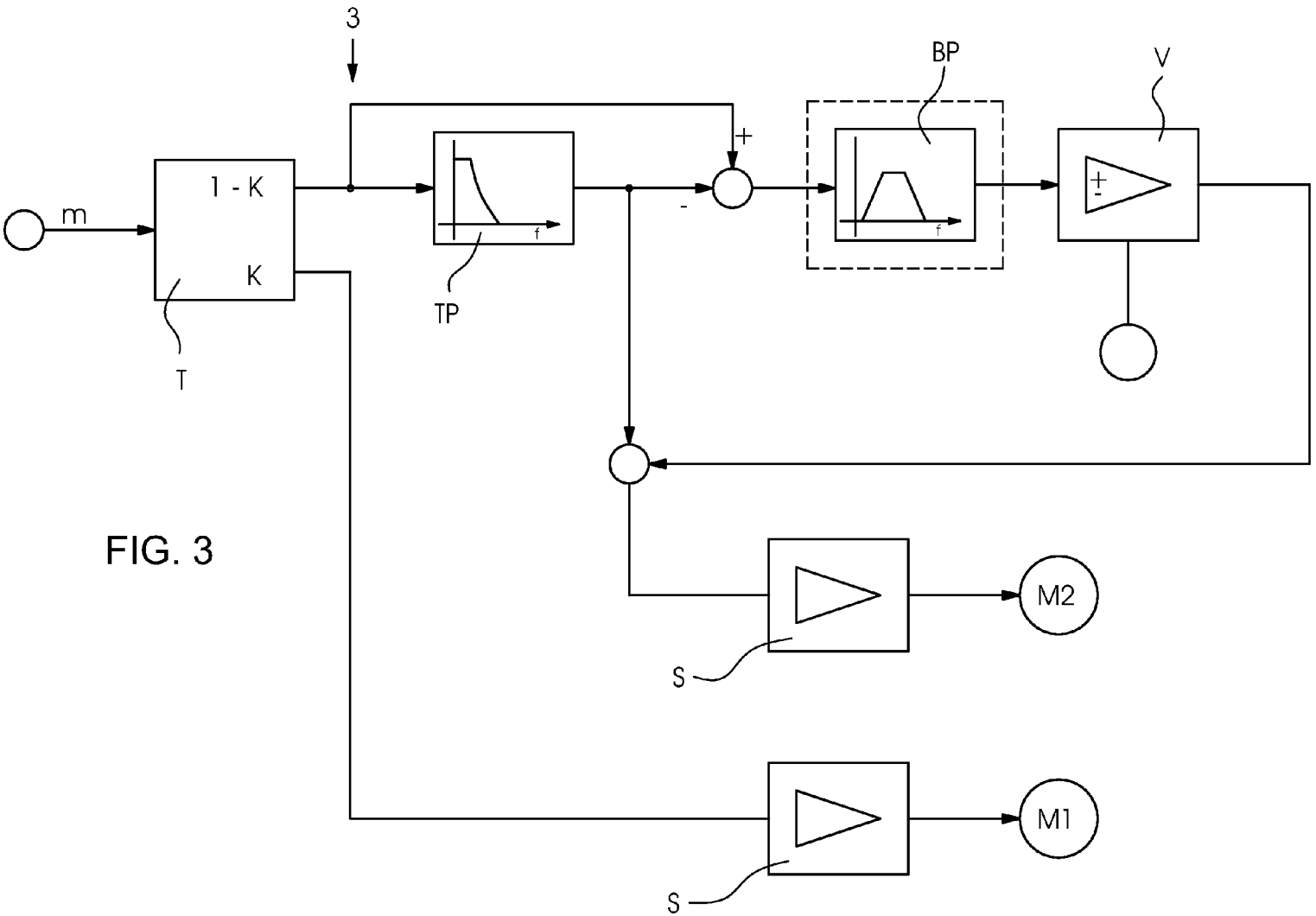
FIG. 3 is a block circuit diagram of an alternative control with an adjustable adjustment factor with sign inversion in a higher-frequency control part.

FIG. 3 illustrates an alternative embodiment. In this case, a sum torque m is divided up through the use of a division element T and is supplied through further transmission elements to the drive motors M1 and M2. The sum actuating torque m is taken from an output of a non-illustrated overriding speed governor of a control cascade. The speed governor may be constructed as a PI controller or else it may correspond to another type of construction. An input of this speed governor is fed with the desired and the actual value of the motor M1. A control loop of the second drive motor M2 has a low-pass filter TP, through which higher-frequency components can be filtered out and a remaining component can be supplied to a second control branch. Furthermore, the torque of the associated divider output is led past the low-pass filter TP, and a difference with respect to the output of the low pass filter TP is supplied to a bandpass filter BP for regulating the higher-frequency component and to a torque controller S which generates the torque in the second motor M2 through the torque controller. The filter illustrated as a bandpass filter BP may also correspond to other specially adapted versions and, for example, may be formed of only a low pass filter. The output signal having the vibration component is provided in this case with an adjustable sign in an amplifier V and is thus for active vibration damping. The sign is dependent on the sign of the machine vibrations of the characteristic form at the location of the second drive motor M2. The output signal of the amplifier V is then supplied additionally to the torque controller with the power part S of the second drive motor M2. The first drive motor M1 likewise has a torque controller with a power part S which is acted upon unfiltered, by the corresponding component of the sum torque m after division in the division element T. The sum torque m is the torque actuating signal which is present at the output of the motor speed governor which was already mentioned. Thus, in FIG. 3, too, each of the drive motors M1, M2 is acted upon with a higher-frequency component, only so that the higher-frequency vibration component of the motor M2, if appropriate with sign inversion, is used for vibration reduction. The embodiment according to FIG. 3 is therefore more complicated and more costly than that of FIG. 2.

The invention claimed is:

1. In a sheet-fed rotary printing machine having a plurality of printing units, a gearwheel train mechanically interconnecting the printing units and at least two electric drive motors acting on the gearwheel train, a device for controlling the sheet-fed rotary printing machine, the device comprising:

control loops each associated with a respective one of the electric drive motors;

each of said control loops having a respective higher-frequency control element; and at least one of said control loops having a low-frequency control element;

said low-frequency control element and said higher-frequency control element separating control signals into lower-frequency and higher-frequency components; and said low-frequency control element supplying said lower-frequency component as an output signal picked up at said control loops in a predetermined ratio.

2. The device according to claim 1, wherein said higher-frequency control element is a proportional controller, and said low-frequency control element is an integral controller.

3. The device according to claim 2, which further comprises torque controllers each associated with a respective one of the drive motors, the output signal being a low-frequency output signal of said integral controller allocated to said torque controllers and applied to said torque controllers in said predetermined ratio.

4. The device according to claim 3, wherein said predetermined ratio has a negative sign.

5. The device according to claim 2, wherein said proportional controllers have different amplification factors.

6. The device according to claim 1, which further comprises sensors each associated with a respective one of the drive motors for detecting an actual speed or an actual torque.

7. The device according to claim 1, wherein a predetermined sum torque is allocated as a manipulated variable to the drive motors.

8. The device according to claim 1, which further comprises torque controllers each associated with a respective one of the drive motors, at least one of said torque controllers receiving higher-frequency components multiplied by a negative amplification factor.

9. The device according to claim 8, wherein the amplification factor has a sign dependent on a characteristic form of a vibration of the sheet-fed rotary printing machine at a location of a drive motor.

10. The device according to claim 8, which further comprises an adapted filter receiving a higher-frequency component.

11. The device according to claim 10, wherein said adapted filter is a bandpass filter.

12. A sheet-fed rotary printing machine, comprising:

a plurality of printing units;

a gearwheel train mechanically interconnecting said printing units;

at least two electric drive motors acting on said gearwheel train; and a device for controlling the sheet-fed rotary printing machine, the device including control loops each associated with a respective one of said electric drive motors, each of said control loops having a respective higher-frequency control element, and at least one of said control loops having a low-frequency control element;

said low-frequency control element and said higher-frequency control element separating control signals into lower-frequency and higher-frequency components: and said low-frequency control element supplying said lower-frequency component as an output signal picked up at said control loops in a predetermined ratio.

13. The sheet-fed rotary printing machine according to claim 12, which further comprises at least one turning device for mechanically coupling a plurality of said printing units to one another.

14. The sheet-fed rotary printing machine according to claim 13, wherein at least one of said drive motors is disposed upstream of said turning device and at least one of said drive motors is disposed downstream of said turning device.

* * * * *